United States Patent [19]

Mosebach

[11] Patent Number: 4,512,850

[45] Date of Patent: Apr. 23, 1985

[54] PROCESS FOR WET QUENCHING OF COAL-COKE

[75] Inventor: Wilhelm Mosebach, Kamen-Methler, Fed. Rep. of Germany

[73] Assignee: Ruhrkohle Aktiengesellschaft, Essen, Fed. Rep. of Germany

[21] Appl. No.: 333,397

[22] Filed: Dec. 22, 1981

[30] Foreign Application Priority Data

Dec. 24, 1980 [DE] Fed. Rep. of Germany ..... 3049157

[51] Int. Cl.[3] ..... C10B 39/08; C10B 41/00

[52] U.S. Cl. ..... 201/1; 201/39

[58] Field of Search ..... 201/1, 39; 202/227, 202/230, 270

[56] References Cited

U.S. PATENT DOCUMENTS

| | | | |
|---|---|---|---|
| 1,677,973 | 7/1928 | Marquard | 201/39 |
| 3,876,143 | 4/1975 | Rossow et al. | 202/227 |
| 4,025,395 | 5/1977 | Ekholm et al. | 201/39 |
| 4,113,569 | 9/1978 | Mahar | 202/227 |

FOREIGN PATENT DOCUMENTS

| | | | |
|---|---|---|---|
| 0025630 | 3/1981 | European Pat. Off. | 201/39 |
| 688300 | 2/1940 | Fed. Rep. of Germany | 202/227 |
| 917905 | 8/1954 | Fed. Rep. of Germany | 202/227 |
| 2312907 | 2/1974 | Fed. Rep. of Germany . | |
| 837398 | 6/1960 | United Kingdom | 202/227 |

*Primary Examiner*—Bradley Garris

*Attorney, Agent, or Firm*—Nils H. Ljungman

[57] ABSTRACT

Process and apparatus for wet-quenching of hot-coke unloaded from a coke producing oven use water quenching from exclusive overhead tanks in two distinct consecutive phases so as to minimize the wasteful coke-dust generated and so as to limit the final maximum-water content in the produced coke. A high rate of water flow under controlled pressure head is used for a short period of time in the initial phase wherein coke-dust particles generated and rising in the water vapor cloud are washed down and prevented from entering the quenching hood; in a second and final stage, a low rate of water flow is maintained for a longer period of time wherein owing to the hot surface of coke having been already cooled in the first phase, coke-dust is not generated as much, and, the required limits for final water content can easily be maintained. Water supply is drawn from (two) overhead tanks ensuring constant head, and using rapid closing valves in conjunction with an electrically controlled valve and two separate sets of water jets for the two quenching phases respectively.

6 Claims, 3 Drawing Figures

PROCESS FOR WET QUENCHING OF COAL-COKE

FIELD OF THE INVENTION

This invention generally relates to coke-producing operations using coal, and more particularly it concerns control of wet-quenching of hot coke taken out of a coke-oven chamber.

BACKGROUND OF THE INVENTION

Coke is an indispensable ingredient of many industrial and metallurgical operations, for example, blast-furnace, certain smelting operations and certain chemical and purification processes. In order to be able to control the end result of such industrial operations which use coke, it is very essential that the coke should be of uniform predictable quality and meet certain characteristic requirements.

Additionally, the need for a smokeless fuel which would not obnoxiously pollute controlled environments, especially in the face of oil shortages or high price of crude oil, has largely been responsible for the emphasis on the development of sophisticated coke-ovens which produce high quality coke of predictable coke-characteristics such as porosity, volatile content, coherence, swelling, coke-reactivity, mechanical strength and combustibility. The aforesaid coke-characteristics in part are influenced by the coal-grade per se, and partly the nature and extent of initial preparation which the raw coal is put through prior to coking; largely however, coke-characteristics for a given grade of coal and initial preparation are influenced by the control of operating conditions relating to a coke oven where coke is made from coal and influenced as well as coke quenching.

Significantly, control of the wet-quenching operation of coke is quite a crucial step in coke production for the reasons explained later in this text.

Coke ovens are of many types; in the basic or fundamental form, a coke oven is known to be built in the form of a firebrick chamber in a substantially hemispherical shape. Coke ovens of such type are termed "beehive coke ovens". Invariably nowadays with very minor exceptions, beehive coke ovens being old fashioned and somewhat wasteful are obsolete presently; instead, "byproduct ovens" are used for many applications.

Coal is charged into the top of empty coke ovens mechanically and levelled to a uniform layer by a mechanical rake or other means, as the first step in coke-production. Almost immediately after charging because of the heat retained in the oven from previous charges, or because of preheating, gases start evolving from the charged coal. The evolved gases start burning because of combustion air admitted in controlled quantities. More recently, effluent gases because of the aforesaid combustion are collected whereby a portion of the heat contained therein is utilized for generating steam, through the use of a waste-heat boiler.

The mechanical rake or the other means referred to above is usually in the form of a levelling bar which is mounted a pusher machine. The pusher machine invariably is a structure steel carriage which carries a pushing 'ram', the levelling bar and usually a pusher door-extractor; the pusher machine advantageously runs on rails which run along a battery of coke-ovens, and is located wherever desired, opposite to the oven to be pushed. The 'ram' generally consists of a long heavy steel girder (for example, over 50 feet long) terminating in a heavy cast iron head. Preferably, the ram is also provided with a rack and pinion so that the ram may be moved using a motor. When pushing an oven, the head of a ram is moved gently against the coke and the charge is forced out of the oven by means of the ram through a coke guide into a wet-quenching car, which is sometimes referred to as a transfer car.

During wet-quenching of hot coke, coke absorbs water owing to the increased penetration of the quenching water into the pores in the hot coke, unlike in the case of coke at ordinary temperatures. When the quenching water enters the coke pores and the coke temperature decreases as a result of quenching, stresses occur which release particles from the coke mass; these particles end up either as dust or pulverized coke in the quenching carriage. In either event, the particles result in coke in certain amounts lost in the process. It is therefore desirable to perform quenching as conservatively as possible, notwithstanding the fact that requirements of metallurgical plants for coke of particular sizes have become less stringent because coke with a grain size of over 25 mm is considered suitable for iron production, for example, in many types of blast furnace.

On the other hand, the requirements for a specific final water content of the coke are just as stringent as ever. Buyers demand a prescribed maximum final water content in the coke partly because, exceeding the specified maximum final water content results in loss of useful coke mass and specific heating energy. The water content would also influence essential desirable features of porosity, mechanical strength, combustibility, coherence, etc. to various degrees. The attainment of a relatively low final water content in the coke, while desirable, is however more difficult with fine coke than with coarse coke in the quenching process.

To keep the final water content as low as possible and also as uniform as possible in the various grain-size distributions of the coke, a prior art process is known, which is referred to as dump-quenching. In such process, hot coke is quenched on the quenching carriage or a transfer car at time intervals with quenching water during predetermined individual quenching phases. However, such a prior art process has the disadvantage that high emissions occur, and a portion of the coke is lost in the form of dust-emission.

Recently, however, stringent regulations have been applied to industry in general and in particular to coking plants in terms of emissions and effluents such as resulting from quenching, and the regulations may not be violated in order to satisfy the requirements of environmental protection agencies. These regulations generally cannot be met using the known quenching towers of the prior art which are used in large numbers in coking plants because, the quenching vapors entrain too much coke dust. Therefore, to comply with emission regulations, the coke-dust particles must first be totally separated from the effluents by installations in the tower chimney adjacent to the quenching hood. However, the conformity with the emission requirements can be accomplished only to an unsatisfactory degree, if at all, with existing quenching towers despite separation of coke dust by commercially available means. The presently imposed stringent environmental regulations generally require erecting new quenching towers wherein the vapor velocity can be reduced by increasing the crucial tower cross-sections; alternatively, sophisticated installations can be provided with which fewer dust particles are generated. However, it is extremely expensive to build new quenching towers to replace the existing ones from the point of view of high installation costs and additionally the down time needed to tear down the old ones and erect new quenching towers.

The purpose of this invention is to provide wet-quenching of coke in such a way that low emission limits are maintained, using a very economical simple and reliable arrangement. By far, the most desirable arrangement for wet quenching would obviously produce the least amount of wasteful coke dust and would simultaneously provide very uniform wet-quenching from one batch to the next batch of coke produced whereby the percentage of final water content is controlled to be within limits and is substantially uniform for all batches of coke produced within a single production schedule. Such a desirable arrangement would have to be able to control the causes which produce excessive coke dust, excessive final water content and nonuniformity of final water content from batch to batch.

It was found that the efficacy of a well-controlled wet-quenching process depended on the water pressure head throughout each quenching operation, and a critical water-quantity vs. time relationship or profile for each quenching cycle.

In addition to considerations of maintaining a predetermined water pressure head and a known water quantity vs. time relationship, it has been experimentally determined by applicant that wet-quenching of each batch in two discrete consecutive phases would produce the minimum of wasteful coke dust and the least amount of absorbed water.

According to this invention, the first phase comprises supplying quenching water at a relatively higher rate for a short period of time, followed by a relatively low amount of quenching water supplied for a longer time period for the second and final phase.

Since the amount of quenching water is very quickly raised to its maximum value after the quenching carriage is set off in the initial phase of coke quenching, the dust particles are washed out of the generated vapor clouds in a very dense cloud, which prevents dust particles from entering the region of the quenching tower above the quenching hood. In the substantially longer final phase following the initial phase, the amount of water is greatly reduced; dust particles are no longer formed after the hot-coke surface is initially quenched. In the final phase, since the cooled coke is not wetted as much, the customer-requirements for a low final water content can easily be maintained and even surpassed.

The present invention accordingly provides a novel wet-quenching method for coke wherein quenching is performed in at least two distinct stages or phases. In the initial phase, a high rate of water flow under a constant pressure head from an overhead tank is used for a short period of time; in the second and final phase, a low rate of water flow is maintained for a longer period of time under a constant pressure of water; owing to the lower rate of water flow in the second stage, it is relatively less difficult to have a fine control over the maximum final water content.

As to the question of using quenching water supply under a constant head, it is conceivable that pressure regulators and other even more sophisticated devices for controlling pressure head and the total water quantity can be used; however, such devices are amenable to variations and disturbances in the system and are additionally uneconomical. The present invention expediently uses overhead tanks which are filled and kept ready for discharging during quenching, for the quenching operation of each load of coke; thus, the pressure head for the water jets in the first and second stages is determined entirely by the level of water in the overhead tanks and is absolutely independent of supply pressure variations without having to use sophisticated and expensive pressure regulators. Furthermore, the amount of water that can empty to quench each load of coke is limited by the water in storage in the tank. Two significant variables namely, the water pressure head and the quantity of water are controlled in a simple and reliable manner in the invention. The transition from the first quenching phase to the second quenching phase from the point of view of controlling or changing the water flow rate is advantageously achieved by using fast acting valves in the system.

DEFINITION OF THE INVENTION

The invention in its broad form consists in apparatus and a method or a process for wet-quenching of coke to limit wasteful particulate emission of coke dust during quenching, the process being of the type wherein hot coke from a coke oven is hauled under a quenching hood of a quenching tower in a positioned open wet-quenching car, any quenching vapors being discharged through a chimney at the top of the quenching hood, the process comprising: supplying quenching water to sprinklers in at least two distinct stages from an exclusive reservoir of predetermined capacity to provide a substantially constant pressure head of quenching water; sprinkling in an initial stage a first quantity of water which is substantially more than half of said predetermined capacity of water over the hot coke in a known first time-interval so as to cause a water vapor barrier across the quenching hood and to wash any generated particulate coke dust down; and in a second stage sprinkling the remaining quantity of water which is less than said first quantity of water, over the coke for a second time-interval which is substantially larger than the first time-interval, until the end of sprinkling.

In a preferred embodiment, a transfer car or quenching car is brought on rails under a quenching hood provided with an exhaust chimney. Quenching water tanks mounted overhead at a predetermined height above the quenching car are always kept ready filled with water. The tanks are connected selectively and successively to two sets of quenching nozzles which are arranged at a suitable height and location with respect to a known area of the quenching car where the maximum height of coke charge occurs. Advantageously, the water supply from the tanks is started an instant before the quenching carriage is completely positioned under the quenching hood so that emissions from the hot coke surface and other drafts through the exhaust chimney are avoided. For optimum results, after considering the initial quenching is the first phase and the final water content, the total amount of quenching water for each quenching load is determined and accordingly the overhead tanks are filled; the ratio of quenching water quantity system is optimally 2:1. Furthermore, preferably, a thick water vapor barrier is created in the first phase or stage in the region of the largest cross-section of the quenching hood.

BRIEF DESCRIPTION OF DRAWING

The various advantages and features of the invention will be more apparent from the following description of a preferred exemplary embodiment to be understood in conjunction with the accompanying drawing wherein.

DESCRIPTION OF PREFERRED EMBODIMENT

Figure 1:
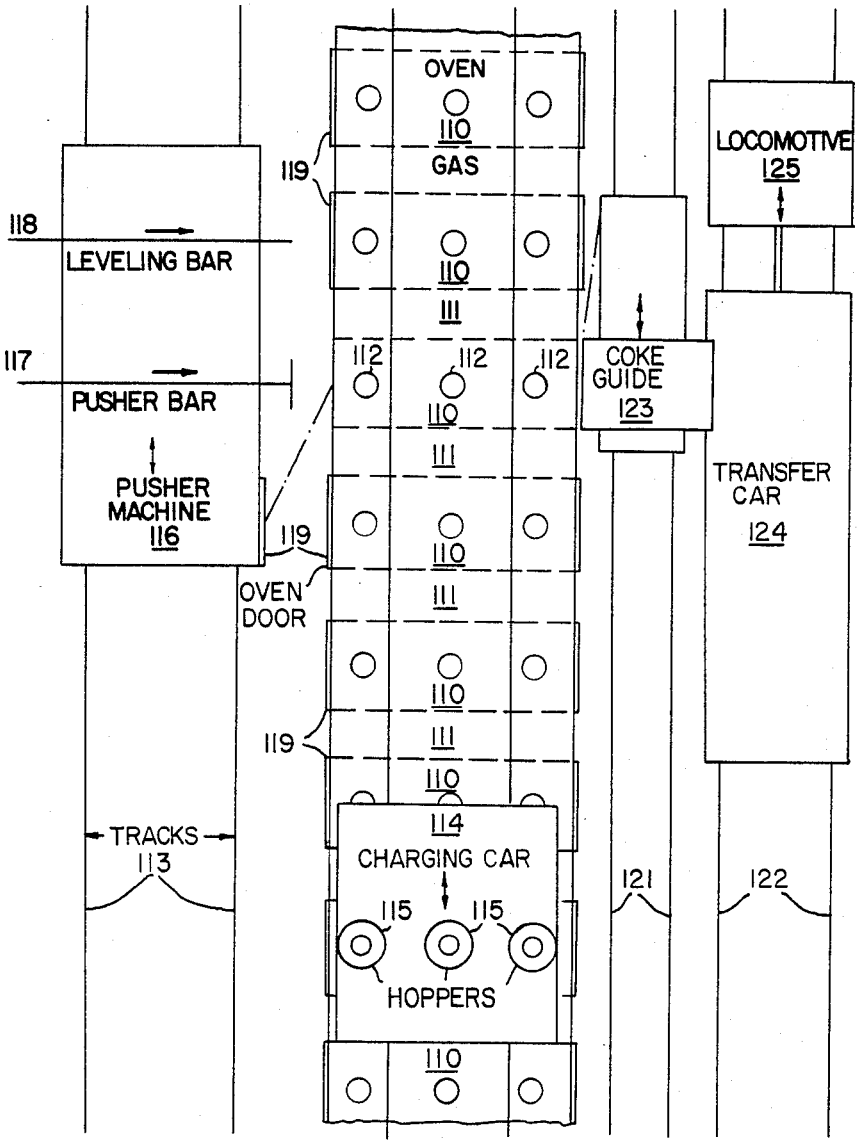
PRIOR ART FIG. 1
FIG. 1 is a diagrammatic illustration of a prior art coke-oven battery where the present invention can be applied.

FIG. 1 generally illustrates a battery of coke ovens 110 having filler holes 112 on which can be aligned hoppers 115 which are capable of being moved over rails. A pusher machine 116 which has a levelling bar 118 and a pusher bar 117 moves on rails or tracks 113 and is capable of being stationed opposite to any selected oven for either levelling the coal-charge or for pushing the coke when it is ready, via a coke guide 123 into a transfer car 124 which can be used for quenching. The car 124 is taken through the wet-quenching arrangement shown in FIGS. 2 and 3 before it is taken for weighing and dispatch or storage. Also illustrated as a typical example of the overall arrangement are the locomotive 125 on tracks 122, and tracks 121 for the coke guide, and oven-doors 119.

Figure 2:
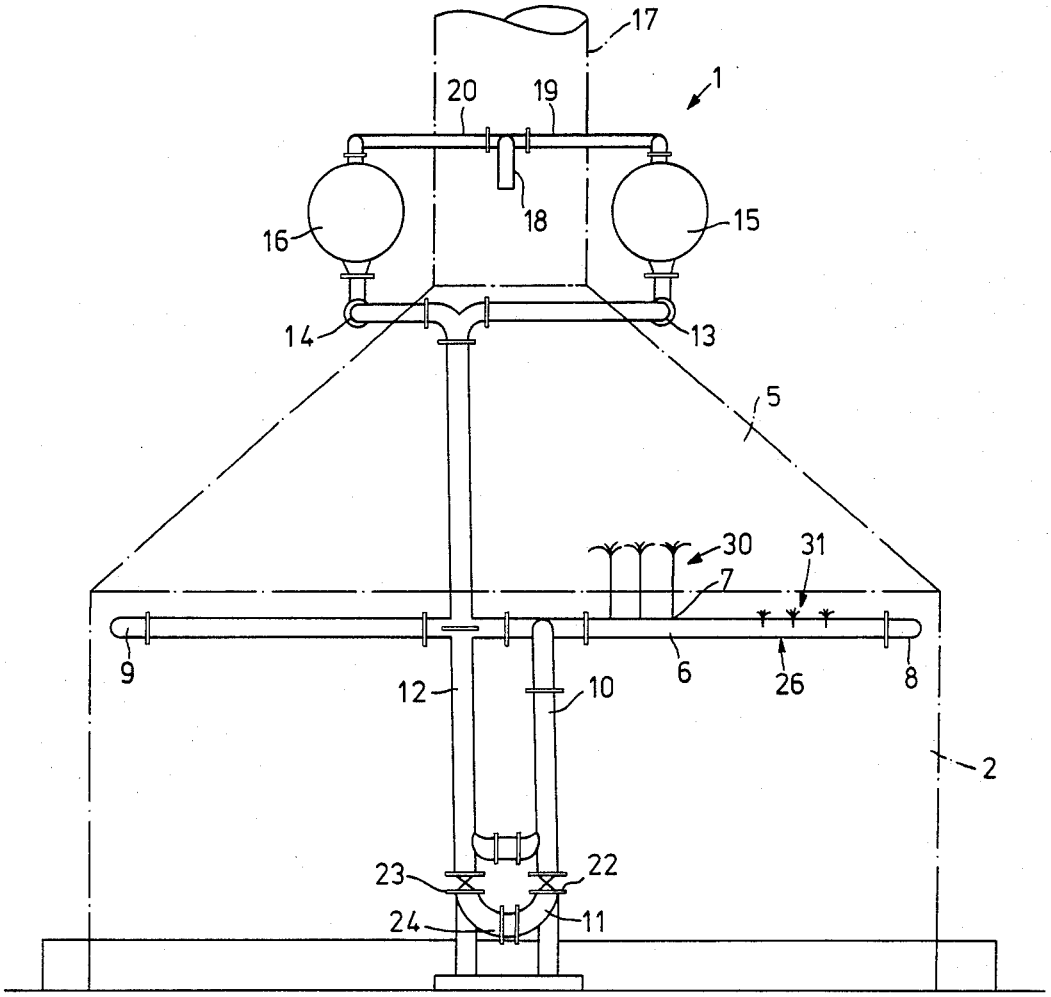
FIG. 2 is a diagrammatic side view showing a skeletal view of an arrangement for practicing a preferred method of the invention.
Figure 3:
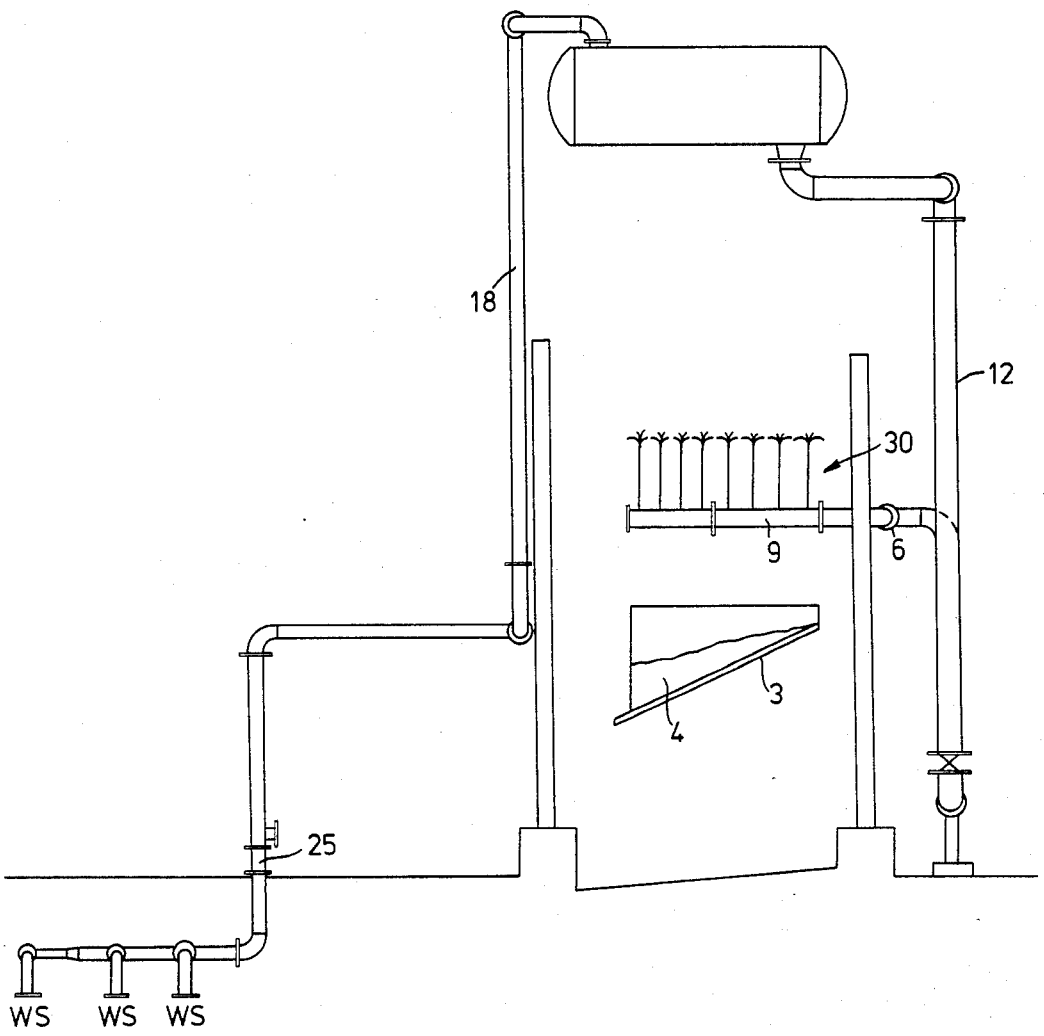
FIG. 3 is a frontal diagrammatic view of the arrangement of FIG. 2.

With reference to FIGS. 2 and 3, the lower portion of a quenching tower generally denoted by the numeral 1 is designed as a quenching carriage room 2. In the carriage room, the coke quenching carriage 3 shown generally and schematically in FIG. 2, is hauled in with the coke batch shown at 4. Provided in the upper portion of the room 2 is a quenching hood 5, which forms the lower portion 1 of the quenching tower; in this region 1, several horizontal pipelines 8,9 are provided, which have at their top regions a plurality of nozzles 7 for discharging quenching water. The pipeline 6 runs as illustrated in FIG. 2, in the longitudinal direction of the quenching carriage track in the room 2. The pipelines 8,9 may be arranged to have a nonuniform section corresponding to the height of the coke layer in the quenching carriage 3—that is, the cross-section of the pipelines 8,9 is preferably greater at the left side of FIG. 3 than at the right side. As a result, the coke is sprinkled uniformly during quenching.

The pipes are filled with quenching water from a riser 10. The riser 10 is connected to a vertically downward pipe 12 via an elbow 11; and said downward pipe 12 is filled from overhead quenching water tanks 15, 16 via branch lines 13, 14. The quenching water tanks 15, 16 are arranged above the hood 5 adjacent the chimney 17. They are filled with fresh water from a common supply line 18 via branch lines 19, 20, before each quenching operation; filling may be accomplished by several pumps, whose supply intake lines WS are shown schematically in FIG. 3; line 18 is connected to the tanks via a check valve 25.

The sprinkler. generally denoted by reference number 26, is subjected to substantially the same pressure at all times from the two overhead tanks 15, 16. For this purpose, rapid closing valves 22, 23 are used, shown schematically in FIG. 2 at the end of the downward pipe 12 and in the riser 10, respectively. A control element 24 is situated in the connection pipe 11. This is a control valve that can change the flow cross-section and is adjusted by an electronic or electric drive. Any commercially available drive can be used for this purpose, and, alternatives available in the market are intelligible to those skilled in the art.

After the quenching carriage 3 is placed in position under a sprinkler 26, a maximum amount of quenching water is allowed at the control valve 24 in a first phase of the quenching process. This is represented schematically by the height of the jets 30 shown in FIGS. 2 and 3 discharging from the upward-directed nozzles 7. This phase lasts, for example, for about 20 seconds.

Subsequently, the valve setting is changed in such a way with electric adjusting device that substantially less quenching water is discharged in a second phase, as represented by the height of the jets 31 in FIG. 2. The second phase is to last till all the quenching water is used; this duration is much longer than the duration of the first phase, as seen in the practical example given herein below.

As a practical example, the plant is designed as follows:

Height of quenching tower: 35 m
Discharge area: 20.4 $m^2$
Mean batch weight: 16.5 t
Mean quenching time: 125 s.
Quenching water quantity-batch: 30 $m^3$
Water supply before entry into the quenching tower.
Mean quenching intensity: 14.55 liter/sec×t of coke
Maximum quenching intensity (20 sec): 26.0 liter/sec×t of coke
Maximum quenching intensity (105 sec): 12.35 liters/sec×t of coke
Quenching sprinkler, 8 pipelines with 1" pipe discharges directed upward.

In the system described above by way of example, the particulate emission target was supposed to be lower than 100 g/t of coke. The measurements of coke-dust particulate emission taken on three consecutive days using the method of the invention yielded the following emission values:

59.0 g/t of coke
76.6 g/t of coke
60.3 g/t of coke, for the three said days respectively.

The foregoing describes in clear terms a process for wet-quenching of hot-coke wherein in particular, the coke dust generated as a wasteful particulate emission is reduced below a minimum target. The process does not require any expensive installation or operating methods, and is very reliable. It is also possible to limit the final water content of the coke without resorting to any sophisticated methods, by simply reducing the amount of water which is used in the second phase.

The foregoing invention is not to be taken to be limited to all the details thereof as described in the example hereinabove, since modifications and variations thereof may be made without departing from the spirit of scope of the invention.

What is claimed is:

1. A process for wet-quenching of coke to limit wasteful particulate emission of coke dust during quenching, the process being of the type wherein hot coke from a coke oven is hauled under a quenching hood of a quenching tower in a positioned open wet-quenching car, any vapors generated during quenching being discharged through a chimney at the top of the quenching hood, the process comprising:

supplying quenching water from a reservoir to sprinklers in at least two distinct stages, said quenching water being supplied in a predetermined quantity at a substantially constant pressure head;

sprinkling in an initial stage using a first set of nozzles directed at a maximum height of coke deposited in said quenching car, a first quantity of water which is substantially more than half of said predetermined quantity of water over the hot coke during a predetermined first time-interval so as to create a water vapor barrier across the quenching hood and to wash any generated particulate coke dust down; and in a second stage, sprinkling a second quantity of water which is less than said first quantity of water, over the coke for a second time-interval which is substantially larger than the first time-interval, until the end of sprinkling, said step of sprinkling in an initial stage being started before said wet-quenching car is completely positioned under said hood of said quenching tower.

2. A process as in claim 1, wherein said first quantity of water is substantially twice said second quantity of water, and said second quantity of water is sprayed using a second set of nozzles distinct from said first set.

3. A process as in claim 1 wherein the step of sprinkling in an initial stage includes sprinkling so as to cause a water-vapor barrier in a region of the largest cross section of the hood.

4. A process as in claim 1, where, with a quantity of 16 tons of coke and a predetermined quantity of 30 $m^3$ of quenching water, said first quantity of water is 26.0 liters/sec for each ton of coke, said first time-interval is 20 seconds, said second quantity of water is 12.35 liters/sec for each ton of coke, and said second time-interval is 105 seconds.

5. A process as in claim 1, including a step of controlling the quantity of water after the initial stage by means of a fast-acting electrically operated valve means in a pipe delivering quenching water from the reservoir to said sprinklers.

6. A process as in claim 1, wherein the step of supplying quenching water includes periodically storing quenching water in an overhead tank means located at a predetermined height above the sprinklers in order to ensure a substantially constant pressure head and a limitation on the total water quantity to be sprinkled.

* * * * *